US005427657A

United States Patent [19]

Sharma

[11] Patent Number: 5,427,657

[45] Date of Patent: Jun. 27, 1995

[54] FUSED FLUORIDE ELECTROLYTES FOR MAGNESIUM OXIDE ELECTROLYSIS IN THE PRODUCTION OF MAGNESIUM METAL

[75] Inventor: Ram A. Sharma, Troy, Mich.

[73] Assignee: General Motors Corporation, Detroit, Mich.

[21] Appl. No.: 246,011

[22] Filed: May 19, 1994

[51] Int. Cl.[6] ..... C25C 3/04; C25C 3/36

[52] U.S. Cl. ..... 204/70; 204/71

[58] Field of Search ..... 204/70, 71, 67

[56] References Cited

U.S. PATENT DOCUMENTS 3,729,397 4/1973 Goldsmith et al. ..... 204/70

3,855,087 12/1974 Yamanaka et al. ..... 204/71

5,071,523 12/1991 Christini et al. ..... 204/67

5,279,716 1/1994 Sharma ..... 204/70

*Primary Examiner*—Kathryn Gorgos

*Attorney, Agent, or Firm*—George A. Grove

[57] ABSTRACT

Magnesium oxide or suitable precursors of magnesium oxide may be dissolved in a molten salt bath comprising magnesium cations, rare earth element cations and fluoride anions and the resultant magnesium containing bath electrolyzed so as to produce a magnesium-rare earth element alloy. While such magnesium-rare earth element alloy has utility as is, electrolytic and chemical practices are also disclosed for reducing the rare earth element content of the magnesium alloy.

6 Claims, 2 Drawing Sheets

FUSED FLUORIDE ELECTROLYTES FOR MAGNESIUM OXIDE ELECTROLYSIS IN THE PRODUCTION OF MAGNESIUM METAL

This invention pertains to the use of certain fused fluoride salt-containing electrolytes that are capable of dissolving magnesium oxide for the efficient and low cost production of magnesium metal by electrolysis. More specifically, this invention pertains to the use of such electrolytes in a practice that produces an alloy containing a major portion of magnesium and a minor portion of rare earth element(s). The invention further pertains to the utility of such alloy and to practices for the separation of the rare earth metal constituent from the alloy in the event that higher magnesium content compositions are desired.

BACKGROUND OF THE INVENTION

My U.S. Pat. No. 5,279,716, "Method for Producing Magnesium Metal from Magnesium Oxide," discloses a practice for utilizing low cost magnesium oxide as a feedstock for an electrolytic process in which a substantially chloride-based salt bath including a rare earth chloride was used as the electrolyte. That process offers the opportunity to substantially reduce the cost of producing magnesium metal because it enables the use of magnesium oxide or a suitable precursor as a feedstock material.

I have now discovered a process that utilizes a fluoride salt electrolyte that offers advantages over my chloride electrolyte process. I have found fluoride electrolyte compositions that provide a broader electrical potential range for magnesium oxide electrolysis without decomposing any of the fluorides in the electrolytes. They also provide higher ionic conductivity, greater capacity for magnesium oxide dissolution and faster rates of magnesium oxide dissolution. Furthermore, my fluoride electrolyte practice provides a method of preparing inexpensive, high quality magnesium-rare earth alloys (such as, for example, magnesium-neodymium alloys) ranging from practically pure magnesium to about 15 weight percent neodymium.

SUMMARY OF THE INVENTION

A rare earth element (RE, also referred to as a lanthanide group element) fluoride salt is utilized in the practice of my invention. In the following description, neodymium fluoride ($NdF_3$) is referred to as a representative rare earth fluoride salt. However, it is to be appreciated that users of the process disclosed below may choose a different rare earth fluoride such as lanthanum fluoride or cerium fluoride, for example, as a constituent of this fluoride salt electrolyte for magnesium production.

As indicated above, an object of my invention is to provide a low cost, efficient and robust electrolyte and process for dissolving magnesium oxide for electrolysis to magnesium metal. A preferred electrolyte consists essentially of lithium fluoride (LiF), calcium fluoride ($CaF_2$), magnesium fluoride ($MgF_2$) and neodymium fluoride ($NdF_3$). A suitable electrolyte bath of these constituents may be formed and operated at a temperature of about 700° C. to 1000° C. Magnesium oxide readily reacts with and dissolves in the bath in the range of five to ten percent by weight of the electrolyte.

Electrolysis is carried out using, for example, a graphite anode and a steel cathode, and may be conducted at an electrical potential of a few volts DC. Electrolysis proceeds to reduce magnesium cations in the bath at the cathode to magnesium metal and produce a pool of magnesium metal on the surface of the more dense molten salt electrolyte.

The magnesium cation content of the bath is thus reduced and is restored by suitable additions of magnesium oxide. Such additions, of course, increase the oxygen content of the bath, apparently by the reaction of magnesium oxide with neodymium cations to form oxyfluoride anions. During the electrolysis process, oxyfluoride anions, or the like, are oxidized and oxygen-containing gases such as carbon monoxide and carbon dioxide are emitted at the graphite anode.

As molten magnesium remains in contact with the rare earth cation-containing bath, the magnesium reacts with the electrolyte to acquire a relatively small amount of rare earth metal in the magnesium floating on the electrolyte. This content increases to 10 to 15 percent by weight of the molten metal layer. The magnesium-rare earth metal alloy is removed from the metal pool over the fluoride electrolyte. The magnesium alloy is substantially free from other constituents such as iron, nickel, copper or boron. This magnesium alloy may be used as is or it may be treated chemically or electrolytically to reduce the rare earth metal content of the alloy.

In a chemical treatment embodiment of my invention, the molten magnesium-rare earth metal alloy is reacted with a molten salt mixture comprising magnesium chloride and rare earth chloride. This chloride salt combination reacts with the rare earth metal in the molten alloy to form the respective rare earth chloride and to replace the rare earth metal with magnesium. In this way, the rare earth content of the Mg-RE alloy can be reduced to a fraction of one percent by weight. In another embodiment of my invention, the molten magnesium-rare earth element alloy is electrolyzed using a molten salt mixture comprising rare earth element cations and chloride anions and the rare earth constituent electrolytically removed from the magnesium alloy, again to reduce the rare earth content of the alloy to a fraction of one percent by weight. There are several ways of conducting this latter electrolysis process so as to operate it in conjunction with the original fluoride electrolyte electrolysis and/or to recover rare earth metal as a separate byproduct. These practices will be described in more detail below.

Accordingly, these and other objects and advantages of my invention will become more clear from a detailed description of my invention which follows. In this description, reference will be had to the figures of the drawing in which:

DESCRIPTION OF THE PREFERRED EMBODIMENT

Production of Magnesium

Figure 1:
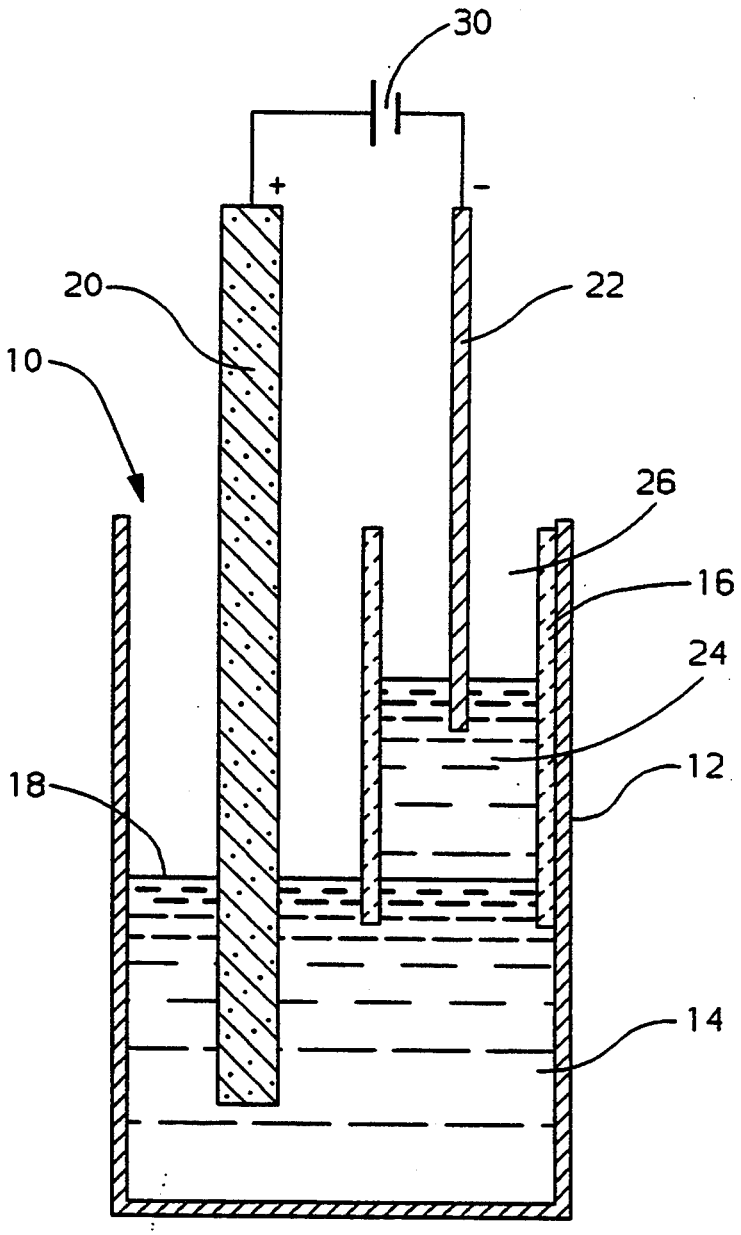
FIG. 1 is a schematic representation of an electrolysis cell for the carrying out of magnesium oxide electrolysis in a fluoride electrolyte in accordance with my invention.

In general, the practice of my invention is applicable to the dissolution of magnesium oxide in a molten fluoride salt electrolyte and to its electrolysis therein to produce magnesium metal or magnesium alloys containing a rare earth constituent. Magnesium oxide or a suitable precursor thereof can be used as a feedstock. An inexpensive source of magnesium oxide, of course, is magnesite, which is magnesium carbonate. The magnesite is heated in a kiln to drive off carbon dioxide gas and produce magnesium oxide suitable as a feedstock to the process that is my invention.

An important aspect of my invention is the composition of the fluoride salt electrolyte. The electrolyte is initially prepared as a mixture of fluoride salts that melt at a suitable temperature and cooperate to provide an electrolyte bath capable of quickly dissolving an appreciable amount of magnesium oxide and serving as an electrolysis medium for the robust production of magnesium metal. A rare earth fluoride is employed to react with magnesium oxide and convert it to magnesium cations and oxygen-containing anions that are soluble in the salt bath. Any of the rare earth metal fluorides such as lanthanum fluoride, cerium fluoride, praseodymium fluoride, neodymium fluoride or even the higher atomic number and more expensive rare earth metal fluorides may be employed. I prefer to describe the practice of my invention utilizing neodymium fluoride. However, it is to be understood that other rare earth metal fluorides, such as $Laf_3$ or $CeF_3$, are suitable for use.

Since magnesium will be a constituent of my bath, I also prefer the use of magnesium fluoride. I also employ lithium fluoride. In general, I employ a bath that contains, roughly speaking, approximately comparable proportions by weight of lithium fluoride, magnesium fluoride and neodymium fluoride. Calcium fluoride is an optional constituent. When magnesium oxide is added to a molten bath of this composition, I believe that it reacts with neodymium fluoride in the bath to form magnesium cations and presumably oxyfluoride anions. However, I do not wish to be limited to the particular mechanism by which the magnesium oxide dissolves and will hereafter refer to my electrolyte composition as containing dissolved magnesium oxide, although magnesium oxide per se is probably not present in the bath. Accordingly, in general, I consider electrolyte compositions initially containing, by weight, from about 27 to 32 percent lithium fluoride (LiF), from 24 to 30 percent magnesium fluoride ($MgF_2$), from 35 to 40 percent neodymium fluoride ($NdF_3$) and from 2 to about 8 percent magnesium oxide in dissolved form as a suitable and preferred electrolyte composition. Small amounts of neodymium oxide, for example up to about 2 percent by weight, may also be dissolved in the electrolyte (probably as its oxyfluoride). Thus, I view the addition of solid magnesium oxide to my molten fluoride electrolyte bath suitably at a temperature of about 700° C. to 1000° C. and preferably at 750° C. to 800° C. as resulting in a chemical reaction in which solid magnesium oxide is convened to a dissolved form of magnesium oxide in which the magnesium species then is most likely in magnesium cationic plus two form (i.e., $Mg^{+2}$) and the oxygen species is likely convened to an oxyfluoride, e.g. $(NdOF_2)^{-1}$, or other anionic chemical species.

An electrolysis reaction is then conducted to electrochemically convert the dissolved magnesium oxide to liquid magnesium metal and an oxygen-containing gaseous byproduct. This reaction is carried out in a suitable cell with the molten metal and electrolyte under an inert gas protective atmosphere. When the process is to be carried out on a continuous mode of operation, means must be provided to add MgO, remove Mg-RE alloy and byproduct gas, and adjust salt composition.

In general, I prefer the use of a graphite anode and a steel cathode in the cell. The electrolyte may be contained in any suitable and chemically compatible vessel including preferably steel. Alumina may be employed as an insulator material where needed. Since an oxygen-containing gas such as carbon monoxide or carbon dioxide will be produced and evolved at the anode and molten low density magnesium will be produced at the cathode, I prefer to separate the cathode compartment from the anode compartment so that the oxygen-containing gas can evolve from the cell without coming into contact with the molten magnesium or magnesium alloy. FIG. 1 is a schematic representation of a cell for the practice of my electrolysis process.

Referring to FIG. 1, my magnesium production cell is indicated generally at 10. The cell 10 includes a cylindrical steel vessel 12 containing the electrolyte 14. A preferred electrolyte is made up to initially contain on a weight percentage basis 33.4 percent lithium fluoride, 23.7 percent magnesium fluoride, 35.3 percent neodymium fluoride, 7.0 percent magnesium oxide and 0.6 percent neodymium oxide ($Nd_2O_3$). The cell 10 within vessel 12 is divided into two chambers by an open-ended refractory alumina container 16 carried by vessel 12 and extending below the upper surface 18 of the electrolyte 14 but not all the way to the bottom of the cell. A graphite anode 20 is supported by means not shown outside of container 16 and immersed in electrolyte 14. A steel cathode 22 is mounted (by means not shown) within refractory container 16. Cathode 22 may be initially immersed in electrolyte 14 but gradually elevated as a molten magnesium layer 24 is produced by electrolysis and collects in the cathode chamber 26 floating on surface 18 of the electrolyte 14. The cell should be designed to prevent oxidation of the molten magnesium by air or other oxygen sources. This can be done by suitable mechanical enclosure of the magnesium pool. It may also be accomplished by use of an inert gas atmosphere such as an atmosphere of argon. The electrolyte is heated by means not shown to 750° C. to 850° C. at which temperature it is liquid.

An electrical potential is applied by source 30 between the electrodes, i.e., anode 20 and cathode 22. The voltage increases to about 2.5 volts. The current reaches a level that depends upon the capacity of the cell. Magnesium metal is generated in the cathode chamber 26 by the electrochemical reaction $Mg^{2+}+2e^{-}\rightarrow$, Mg. Initially, the reaction occurs at the interface of electrolyte 14 and cathode 22 (when immersed) and thereafter at the interface of pool 24 of molten magnesium and molten fluoride electrolyte 14. Additional magnesium oxide may be added continually to the electrolyte to make up for the magnesium metal that is derived from the electrolyte. Concomitantly, oxygen is evolved from the electrolyte 14 at anode 20 per the reaction $O^{2-}+C\rightarrow CO(CO_2)+2e^{-}$.

While the neodymium fluoride is generally considered to be more stable than magnesium fluoride, I have found that magnesium in pool 24 reacts with neodymium cations in the electrolyte bath 14 presumably until an equilibrium between pool 24 and bath 14 is reached. Thus, the molten alloy pool 24 floating on the electrolyte will contain some neodymium metal dissolved in magnesium.

The rare earth constituent is beneficial to the magnesium, and the magnesium-rare earth alloy may be drawn from the molten metal pool, allowed to solidify and used as is. The alloy is substantially free of impurities such as iron, copper, nickel and boron that are often found in magnesium. However, I also contemplate practices for the removal of the molten magnesium rare earth alloy from cathode chamber 26 for chemical or electrolytic treatments that will reduce the rare earth metal content of the magnesium to a fraction of a percent by weight.

Refinement of the Magnesium-Rare Earth Element Alloy

In accordance with one practice of my invention, magnesium-neodymium alloy may be removed from the production cell 10 while still molten and brought into contact with a suitable magnesium chloride-neodymium chloride molten salt mixture to dissolve unwanted neodymium and produce a magnesium melt of desired composition. One mole of neodymium (or other lanthanide constituent) in the molten magnesium selectively reacts with one and one-half moles of magnesium chloride in the salt to form one mole of neodymium chloride which dissolves in the salt and one and one-half moles of magnesium which is miscible in the melt. At the completion of this reaction, the molten magnesium is separated from the molten salt and solidified as magnesium with a minimal or predetermined amount of neodymium. The salt can be cooled to room temperature, dissolved in water and treated with magnesium hydroxide to produce a magnesium chloride solution and a neodymium hydroxide precipitate. The neodymium hydroxide can be converted to dry neodymium oxide, which can be added as a recycle material to the electrolytic cell with magnesium oxide. Similarly, magnesium chloride can be recovered and used in the refinement process.

Figure 2:
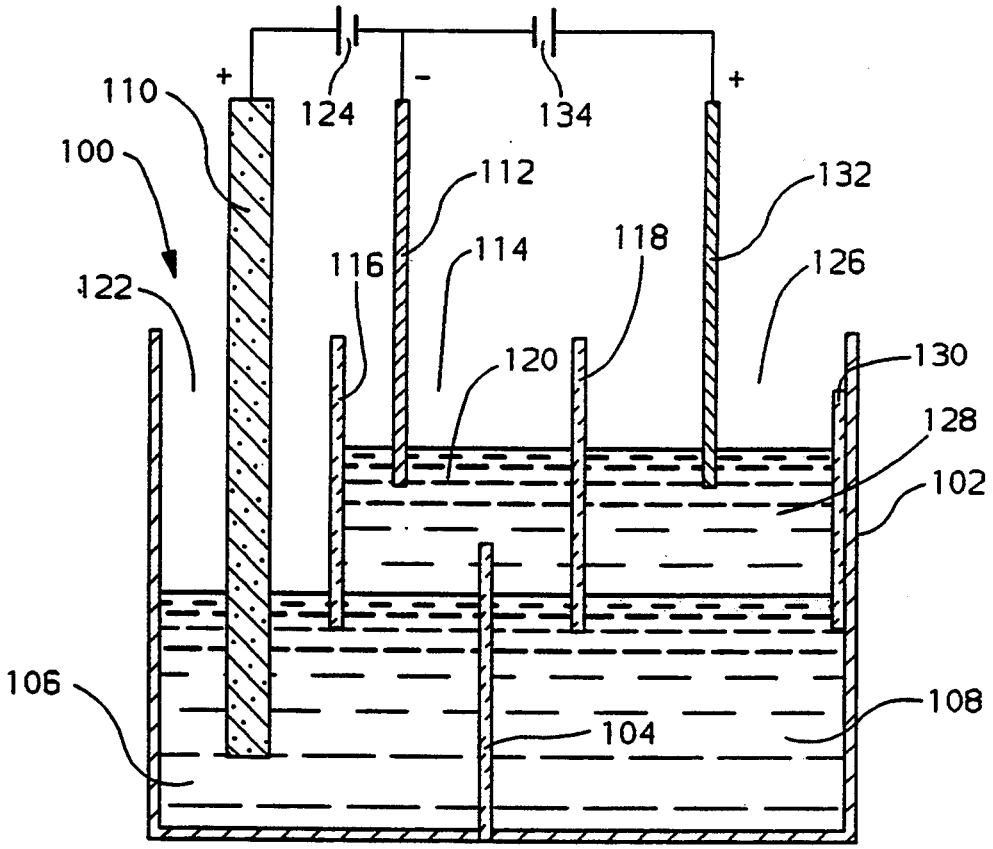
FIG. 2 is a schematic diagram of a magnesium production and refining cell depicting a first mode of operation to recover magnesium of a desired purity.

In an alternative practice to the above chemical treatment, the magnesium-neodymium alloy can be electrolytically processed in a combination magnesium production and refining cell 100 as depicted in FIG. 2. The magnesium production portion of the production refining cell is like that of FIG. 1. However, the cell 100 of FIG. 2 is a rectangular steel vessel 102 divided into two chambers by an alumina refractory partition 104 extending across vessel 102. The left-hand chamber as viewed in FIG. 2 is adapted to contain a mixed fluoride salt electrolyte for the production of magnesium metal in accordance with my invention. This electrolyte designated 106 may be the same composition as that described in connection with the operation of cell 10 in FIG. 1 or other suitable fluoride salt composition. The right-hand chamber as seen in FIG. 2 is adapted to contain a molten chloride salt electrolyte 108 which will be employed to refine the magnesium neodymium alloy 120 produced in combination with electrolyte 106. A suitable chloride salt electrolyte 108 for refining purposes may contain a mixture of sodium (or other alkali metal) chloride, calcium (or other alkaline earth metal) chloride and neodymium (i.e., rare earth) chloride. An example of a specific preferred electrolyte composition initially consists by weight of 26 percent sodium chloride, 54 percent calcium chloride and 20 percent neodymium chloride. In general, lower neodymium (RE) content in the refining electrolyte 108 produces lower neodymium (RE) content in the alloy being refined. Both the magnesium production fluoride electrolyte 106 and the magnesium alloy refining chloride electrolyte 108 are maintained in the molten state in their respective chambers of vessel 102 at a temperature of about 750° C. to 800° C. by any suitable means. The operating cells of vessel 102 may be maintained under argon or other suitable inert atmosphere and means provided for the introduction of feed stock materials and the removal of products and byproducts.

Immersed in fluoride electrolyte 106 is a graphite anode 110 and employed in connection with the fluoride electrolyte 106 is a steel cathode 112. Cathode 112 is adapted and supported to operate in a cathode chamber 114 which is defined within or between alumina refractory partitions 116 and 118. It is seen that the cathode chamber 114 overlies refractory partition 104 so that the magnesium-rare earth metal containing molten alloy 120 produced in conjunction with the fluoride salt electrolyte 106 eventually rises above the top of partition 104 and floats on both fluoride electrolyte 106 and chloride electrolyte 108. The anode chamber 122 in which anode 110 is supported immersed in electrolyte 106 is outside of the cathode chamber 114. Direct current electropotential generating means 124 is connected between anode 110 and cathode 112. The operation of the magnesium-producing electrolytic cell in accordance with my invention is like that described in FIG. 1 except that the magnesium alloy generally containing some neodymium or other rare earth metal floats as an immiscible layer or pool 120 over both of electrolytes 106 and 108 in order to be subject to the refining process which occurs in connection with the refining chloride electrolyte 108.

In the operation of the subject magnesium production-refining cell 100, portions of the molten magnesium neodymium alloy 120 are transferred from time to time from the cathode chamber 114 into the refining anode chamber 126 in which the molten alloy being refined is designated as 128. It is seen that refining alloy 128 is contained between refractory alumina partition 118 and a refractory alumina partition 130 supported on the steel walls of vessel 102. The molten magnesium refining layer 128 is thus confined in anode chamber 126 so that it floats only upon the chloride refining electrolyte 108. Immersed in the magnesium refining pool 128 is steel anode 132. Anode 132 does not need to extend into the electrolyte 108 because both pool 128 and electrolyte 108 are electrically conductive. Electropotential charging means 134 is connected between steel anode 132 and steel cathode 112. Thus, in this embodiment of my invention, both graphite anode 110 in the fluoride electrolyte magnesium production cell and steel anode 132 in the magnesium refining cell are electrically positive with respect to steel cathode 112.

The magnesium production cell with electrolyte 106 operates substantially the same way as the production cell 10 described with respect to FIG. 1. After cell startup as depicted in FIG. 2, magnesium metal is produced in cathode chamber 114 at the interface of electrolyte 106 and pool 120. As disclosed above, the magnesium metal in pool 120 reacts with neodymium fluoride in electrolyte 106, forming neodymium metal which accumulates in pool 120. However, for the operation of the refining cell (electrolyte 108), neodymium-containing alloy is transferred from pool 120 to form pool 128. When anode 132 is electrically connected at a suitable potential to cathode 112, magnesium metal from pool 128 is oxidized at the interface of pool 128 with electrolyte 108. Neodymium metal undergoes oxidation to $Nd^{+3}$ anions in the salt layer 108. At the same time, $Nd^{+3}$ anions in electrolyte 108 are reduced at the interface of salt layer 108 and magnesium pool 120 to transport neodymium metal into pool 120.

Thus, the overall effect of the refining cell is to transport only neodymium metal ($Nd^0$) from Mg-Nd pool 128 by way of electrolyte 108 ($Nd^{+3}$) to Mg-Nd pool 120. By thus returning neodymium to pool 120, the electrochemical equilibrium of neodymium between pool 120 and salt bath 106 retards further neodymium transport from salt bath 106 to pool 120. In the operation of the magnesium production-refining cell 100 depicted in FIG. 2, magnesium metal is produced in the production cell and temporarily accumulated as a pool 120 which also contains neodymium metal. Portions of pool 120 are transported to the magnesium refining cell as pool 128. In the refining cell, neodymium metal is sequentially transported from pool 128 into refining electrolyte 108 and back into pool 120. Thus, the magnesium in refined pool 128 is stripped of neodymium metal to a desired RE content which may be less than one percent by weight. From time to time, MgO is added to the production cell and the product magnesium alloy is removed from pool 128. Neodymium is retained within cell 100, and only relatively small amounts of makeup $Nd_2O_3$ need be added to electrolyte 106 in this embodiment of the invention.

Figure 3:
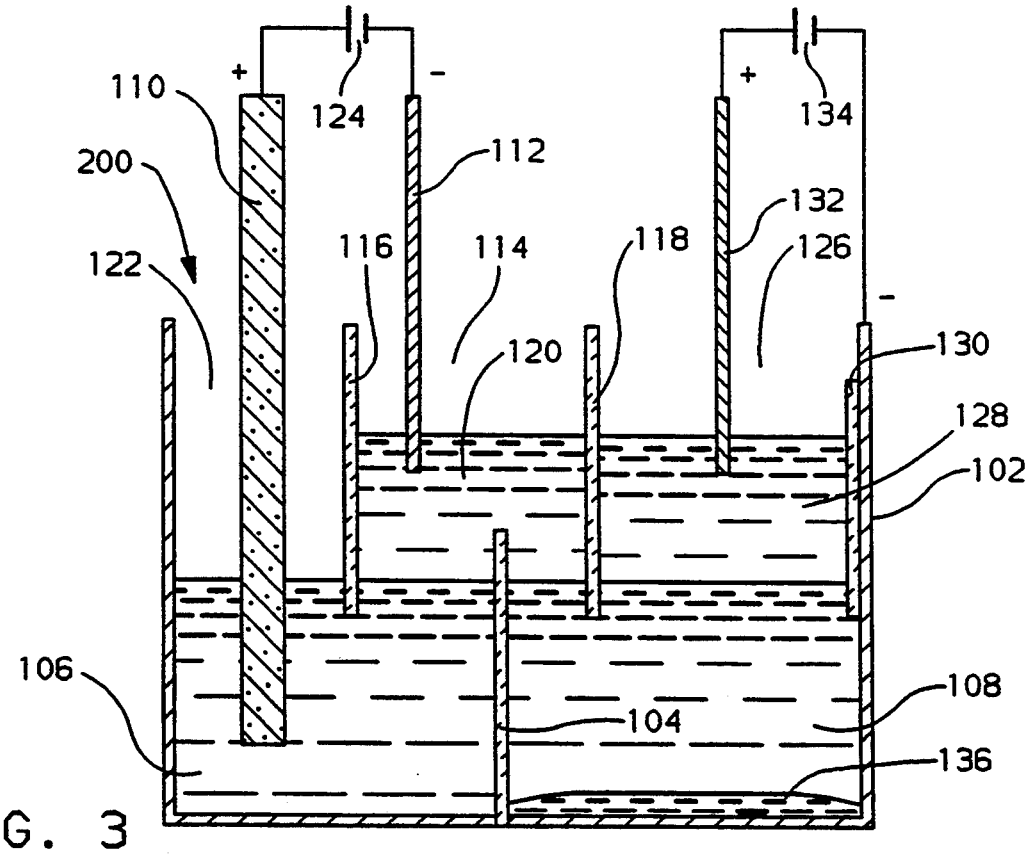
FIG. 3 is a schematic diagram like that of FIG. 2 depicting a second mode of operation to recover magnesium of a desired purity and neodymium in an iron-neodymium pool.

FIG. 3 depicts an alternative embodiment of the operation of a magnesium production-refining cell 200 similar to that depicted in FIG. 2. The process that will be described in connection with the cell 200 may be carried out on a full-time basis or intermittently with the process described in connection with cell 100 in FIG. 2. The process depicted in FIG. 3 differs from that depicted in FIG. 2 in that the neodymium or other rare earth constituent is transported from the Mg-RE pool 128 to be refined into a neodymium collecting pool rather than back into the magnesium production pool. Since the magnesium production and refining cell depicted in FIG. 3 is (except for one electrical connection) mechanically like that in FIG. 2, similar elements are given the same numbers. The principal difference is that the steel anode 132 is connected through charging means 134 to steel vessel 102, which serves as the cathode for the refining cell (electrolyte 108). Furthermore, there is a molten metal collection pool for the neodymium metal that is produced in the refining cell. This molten metal collection pool 136 is a suitable eutectic or low melting point alloy of the rare earth, for example neodymium, with iron or, zinc or other desired alloying constituent.

The overall operation of the magnesium production and magnesium refining cell 200 is in most respects identical to the operation of cell 100 in FIG. 2 except that the neodymium or other rare earth constituent from the magnesium alloy pool 128 is oxidized and transported into the chloride electrolyte 108 and thence reduced and transported into the neodymium collection pool 136. By the arrangement depicted in FIG. 3, the rare earth constituent is not returned to the magnesium production pool 120.

By providing means to switch anode 132 alternately from cathode 102 (steel vessel) to cathode 112 (FIG. 2), cell 200 as shown could be operated to intermittently collect the rare earth constituent into a collection pool 136 and then alternately returned into the magnesium production pool 120. When the complex cell 200 is to be operated solely in a neodymium production mode, then it is apparent that refractory partitions 104 and 118 may be simply a single partition that extends above the level of the magnesium production pool 120, and there is no reason for the production pool 120 to then overlie the chloride electrolyte 108.

In the embodiment illustrated in FIG. 3, magnesium metal is produced in the cell utilizing the fluoride electrolyte 106 and temporarily accumulated as pool 120. Mg-RE alloy from pool 120 is transferred to pool 128 for refining. Rare earth metal (Nd) is transported electrochemically from pool 128 through chloride electrolyte to RE collection pool 136. Thus, magnesium is removed from the cell 200 when pool 128 has been suitably refined of RE metal. RE metal is removed as collection pool 136. Suitable makeup or fuel streams of MgO and $Nd_2O_3$ are added to electrolyte 106.

In summary, the subject fluoride-based electrolyte with its $RE\text{-}F_3$ constituent facilitates a robust electrolysis process for the production of magnesium metal from inexpensive, readily available MgO or a precursor of MgO. In terms of feed stock and electrolytes, this process is analogous to the Hall-Heroult process for producing aluminum by electrolysis of alumina dissolved in cryolite. However, the subject process produces a magnesium-rare earth alloy that may be used as is or refined to produce magnesium and recycle or recover the RE constituent.

Thus, while my invention has been described in terms of certain preferred embodiments thereof, it will be appreciated that other forms could readily be adapted by one skilled in the art. Accordingly, the scope of my invention is to be considered limited only by the following claims.

The embodiments of the invention in which an exclusive property or privilege is claimed are defined as follows:

1. A method of producing magnesium metal by electrolysis of magnesium oxide, comprising:

adding magnesium oxide to a molten salt electrolyte mixture comprising magnesium cations, lithium cations, rare earth element cations and fluoride anions, the rare earth element content of said bath is at least chemically equivalent to said magnesium oxide addition to dissolve said magnesium oxide in said molten salt mixture, electrolyzing the resultant solution utilizing a cathode and an anode to produce molten magnesium at the cathode, which magnesium accumulates as a molten metal layer floating on said molten salt electrolyte, said molten metal layer reacting with said molten salt to accumulate a minor portion of rare earth metal in the molten magnesium, and continuing to make magnesium oxide additions to said salt mixture while maintaining an amount of rare earth element cations in said salt mixture that is at least chemically equivalent to the amount of magnesium oxide is added to said mixture.

2. The method of producing magnesium as recited in claim 1 where said molten salt mixture comprises by weight 27 to 32 percent lithium fluoride, 24 to 30 percent magnesium fluoride, 35 to 40 percent rare earth fluoride, and 2 to 8 percent magnesium oxide.

3. A method of producing magnesium metal by electrolysis of magnesium oxide comprising:

dissolving magnesium oxide in a first molten salt mixture comprising magnesium cations, lithium cations, rare earth element cations and fluoride anions, electrolyzing said first salt mixture to produce a first molten alloy pool floating on the surface of said first salt mixture, said first molten alloy consisting essentially of a major portion of magnesium and a minor portion of rare earth element metal, transferring molten alloy from said first pool into contact as a second pool with a second molten salt mixture comprising rare earth element cations and chloride anions, and electrolyzing said second alloy pool and second salt mixture to remove at least a portion of said rare earth element constituent from said second alloy pool to produce magnesium metal of desired rare earth element residual content.

4. A method of producing magnesium metal by electrolysis of magnesium oxide comprising:

dissolving magnesium oxide in a first molten salt mixture comprising magnesium cations, lithium cations, rare earth element cations and fluoride anions, electrolyzing said first salt mixture to produce a first molten alloy pool floating on the surface of said first salt mixture, said first molten alloy consisting essentially of a major portion of magnesium and a minor portion of rare earth element metal, transferring molten alloy from said first pool into contact as a second pool with a second molten salt mixture comprising rare earth element cations, sodium cations, calcium cations and chloride anions, and electrolyzing said second alloy pool and second salt mixture to remove at least a portion of said rare earth element constituent from said second alloy pool to produce magnesium metal of desired rare earth element residual content and to transport electrochemically said portion of rare earth element constituent back into said first pool.

5. A method of producing magnesium metal as recited in claim 4 in which: (a) magnesium oxide is added as necessary to permit continuous production of said first molten alloy pool, at least intermittent transfer of molten alloy from said first pool to said second pool and at least intermittent removal of magnesium metal from said second pool, and (b) the rare earth cation content of said first salt mixture is maintained at least in part due to the electrolysis of said second alloy pool and second salt mixture.

6. A method of producing magnesium metal by electrolysis of magnesium oxide comprising:

dissolving magnesium oxide in a first molten salt mixture comprising magnesium cations, lithium cations, rare earth element cations and fluoride anions, electrolyzing said first salt mixture to produce a first molten alloy pool floating on the surface of said first salt mixture, said first molten alloy consisting essentially of a major portion of magnesium and a minor portion of rare earth element metal, transferring molten alloy from said first pool into contact as a second pool with a second molten salt mixture comprising rare earth element cations and chloride anions, and electrolyzing said second alloy pool and second salt mixture to remove at least a portion of said rare earth element constituent from said second alloy pool to produce magnesium metal of desired rare earth element residual content, said rare earth element constituent being first transported electrochemically as rare earth cations into said second salt mixture and thereafter transported as rare earth element metal into a molten metal alloy underlying said second salt mixture.

* * * * *